US010640340B2

(12) United States Patent
Kuhn et al.

(10) Patent No.: US 10,640,340 B2
(45) Date of Patent: May 5, 2020

(54) MOBILE CRANE FOR ANGLING A MAIN JIB EXTENSION RELATIVE TO A MAIN JIB OF A MOBILE CRANE

(71) Applicant: Terex Global GmbH, Schaffhausen (CH)

(72) Inventors: Roland Kuhn, St. Ingbert (DE); Michael Martin, Illingen (DE)

(73) Assignee: Terex Global GmbH, Schaffhausen (CH)

( * ) Notice: Subject to any disclaimer, the term of this patent is extended or adjusted under 35 U.S.C. 154(b) by 0 days.

(21) Appl. No.: 15/778,432

(22) PCT Filed: Nov. 22, 2016

(86) PCT No.: PCT/EP2016/078461
§ 371 (c)(1),
(2) Date: May 23, 2018

(87) PCT Pub. No.: WO2017/089353
PCT Pub. Date: Jun. 1, 2017

(65) Prior Publication Data

US 2018/0339889 A1 Nov. 29, 2018

(30) Foreign Application Priority Data

Nov. 24, 2015 (DE) ..... 10 2015 120 350

(51) Int. Cl.
*B66C 23/70* (2006.01)
*B66C 23/68* (2006.01)
(Continued)

(52) U.S. Cl.
CPC ..... *B66C 23/702* (2013.01); *B66C 23/06* (2013.01); *B66C 23/42* (2013.01); *B66C 23/68* (2013.01); *B66C 23/82* (2013.01)

(58) Field of Classification Search
CPC ..... B66C 23/68; B66C 23/701; B66C 23/702; B66C 23/06; B66C 23/42; B66C 23/82
See application file for complete search history.

(56) References Cited

U.S. PATENT DOCUMENTS 3,085,695 A * 4/1963 Miller ..... B66C 23/70 212/177
4,394,941 A 7/1983 Privat
(Continued)

FOREIGN PATENT DOCUMENTS

CN 1138005 A 12/1996
CN 2364010 Y 2/2000
(Continued)

OTHER PUBLICATIONS

Preliminary Report on Patentability of the International Searching Authority in English from corresponding Patent Cooperation Treaty (PCT) Application No. PCT/EP2016/078461, completed May 29, 2018.
(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A mobile crane having a tiltably mounted main jib which can be erected by a tilting cylinder, and having a main jib extension releasably connected to a main jib head of the main jib by upper and lower bolts. Starting from a normal position, after release of the upper bolts, the main jib extension can be angled about a tilting axis relative to the main jib by an angling drive that engages on a foot of the main jib extension, and a drive that is provided for another purpose supplies the kinetic energy for the angling drive. The angling drive includes a lever element having two lever arms, pivotably mounted on the upper chord of the main jib
(Continued)

extension, with the first lever arm being connected to a lifting cable of the lifting gear for operation of the angling drive and engaging the main jib head by the second lever arm.

14 Claims, 8 Drawing Sheets

(51) Int. Cl.

| | |
|---|---|
| ***B66C 23/06*** | (2006.01) |
| ***B66C 23/42*** | (2006.01) |
| ***B66C 23/82*** | (2006.01) |

(56) References Cited

U.S. PATENT DOCUMENTS

| | | | | |
|---|---|---|---|---|
| 4,653,655 | A * | 3/1987 | Rathi | B66C 23/702 212/177 |
| 4,828,124 | A | 5/1989 | Iga | |
| 5,842,587 | A * | 12/1998 | Wanek | B66C 23/82 212/177 |
| 9,056,752 | B2 | 6/2015 | Müller et al. | |
| 9,090,436 | B2 | 7/2015 | Franzen et al. | |
| 9,272,883 | B2 | 3/2016 | Behnke | |
| 2005/0011850 | A1* | 1/2005 | Hinrichs | B66C 23/702 212/300 |
| 2005/0098524 | A1* | 5/2005 | Irsch | B66C 13/18 212/300 |
| 2010/0213152 | A1* | 8/2010 | Martin | B66C 23/18 212/177 |
| 2010/0294738 | A1* | 11/2010 | Martin | B66C 23/344 212/347 |
| 2010/0329773 | A1* | 12/2010 | Martin | B66C 23/702 403/3 |
| 2017/0066632 | A1 | 3/2017 | Hegewald | |
| 2018/0044149 | A1 | 2/2018 | Weckbecker et al. | |
| 2018/0327234 | A1 | 11/2018 | Martin et al. | |
| 2018/0346291 | A1 | 12/2018 | Martin et al. | |
| 2018/0346292 | A1 | 12/2018 | Kuhn et al. | |

FOREIGN PATENT DOCUMENTS

| | | | |
|---|---|---|---|
| CN | 101628691 | A | 1/2010 |
| CN | 101687618 | A | 3/2010 |
| CN | 201458603 | U | 5/2010 |
| CN | 1018330403 | A | 9/2010 |
| CN | 102862921 | A | 1/2013 |
| CN | 103359636 | A | 10/2013 |
| CN | 102602825 | B | 7/2014 |
| DE | 291531 | A5 | 7/1991 |
| DE | 202004020760 | U1 | 3/2006 |
| DE | 10321493 | B4 | 7/2006 |
| DE | 102009010452 | A1 | 9/2010 |
| DE | 102012023814 | A1 | 6/2014 |
| DE | 102014003831 | A1 | 9/2015 |
| EP | 1081088 | A1 | 3/2001 |
| EP | 2253576 | A1 | 11/2010 |
| FR | 2075866 | A1 | 10/1971 |
| FR | 2719574 | A1 | 11/1995 |
| GB | 1470488 | | 4/1977 |
| GB | 2081210 | A | 2/1982 |
| JP | S60100390 | U | 7/1985 |
| JP | H09104588 | A | 4/1997 |

OTHER PUBLICATIONS

International Search Report of the International Searching Authority from corresponding Patent Cooperation Treaty (PCT) Application No. PCT/EP2016/078461, indicated completed on Feb. 20, 2017.

Written Opinion of the International Searching Authority from corresponding Patent Cooperation Treaty (PCT) Application No. PCT/EP2016/078461, indicated completed on Feb. 20, 2017.

* cited by examiner

MOBILE CRANE FOR ANGLING A MAIN JIB EXTENSION RELATIVE TO A MAIN JIB OF A MOBILE CRANE

CROSS REFERENCE TO RELATED APPLICATIONS

The present application claims the priority benefits of International Patent Application No. PCT/EP2016/078461, filed Nov. 22, 2016, and claims benefit of German patent application DE 10 2015 120 350.2, filed Nov. 24, 2015.

BACKGROUND OF THE INVENTION

The invention relates to a mobile crane with a main jib luffably mounted thereon and able to be raised via a luffing cylinder, and with a main jib extension releasably connected to a main jib head of the main jib via upper bolts and lower bolts, the main jib extension, starting from a basic position after release of the upper bolts, is able to be angled about a luffing axis relative to the main jib by means of an angling drive, the angling drive engages on a foot of the main jib extension, wherein a lifting mechanism of the mobile crane, which is provided for another task, provides the movement energy for the angling drive.

The invention also relates to a method for angling a main jib extension relative to a main jib of a mobile crane, wherein the main jib is luffably mounted on the mobile crane and can be raised via a luffing cylinder, the main jib extension is releasably connected to a main jib head of the main jib via upper bolts and lower bolts and an angling drive engages on a foot of the main jib extension.

German utility model DE 20 2004 020 760 U1 already discloses a mobile crane with a main jib and a main jib extension fastened to its main jib head. The main jib extension is luffable from a basic position, in which the main jib extension is oriented with its longitudinal direction as an extension of the longitudinal direction of the main jib, into a 20° position and a 40° position. In a conventional manner, the main jib extension is releasably fastened to the main jib head via two lower bolts disposed in the region of bottom chords of the main jib extension and two upper bolts disposed in the region of top chords of the main jib extension. In order to be able to luff the main jib extension about the two lower bolts serving as a luffing axis out of the basic position, in a first step the two upper bolts are pulled and in a second step, by means of hydraulic luffing cylinders which engage on the main jib head and on the main jib extension, the luffing of the main jib extension is effected. The insertion and pulling of the two upper bolts is effected in each case via a hydraulic bolting cylinder. In order to power the luffing cylinders and the bolting cylinders an autonomous hydraulic assembly is disposed at the lower end of the main jib extension. It is possible to use e.g. a diesel engine or an electric motor, in each case with an associated hydraulic pump, as the hydraulic assembly.

German patent specification DD 291 531 A5 relates to a mobile crane with an angling plate between a main jib and a main jib extension, wherein the main jib extension, starting from a basic position after release of a holding bolt, can be angled by means of an angling drive about a luffing axis. The movement energy required for this is supplied by a lifting cable of the mobile crane.

A mobile crane with a main jib is also known from the German laid-open document DE 10 2009 010 452 A1. A lifting cable is inter alia used to mount and dismount a main jib extension to/from the main jib.

SUMMARY OF THE INVENTION

The present invention provides a mobile crane and a method for angling a main jib extension relative to a main jib of a mobile crane, with which the angling of the main jib extension is simplified.

In accordance with the invention, in the case of a mobile crane with a main jib luffably mounted thereon and able to be raised via a luffing cylinder, and with a main jib extension releasably connected to a main jib head of the main jib via upper bolts and lower bolts, wherein the main jib extension, starting from a basic position after release of the upper bolts, is able to be angled about a luffing axis relative to the main jib by means of an angling drive, the angling drive engages on a foot of the main jib extension, wherein a lifting mechanism of the mobile crane, which is provided for another task, provides the movement energy for the angling drive, a simplification is achieved by virtue of the fact that the angling drive comprises a lever element having two lever arms, the lever element is pivotably mounted on the top chord of the main jib extension, the first lever arm is connected to a lifting cable of the lifting mechanism for operating the angling drive and engages on the main jib head via the second lever arm. This ensures that the angling procedure is not performed by means of external auxiliary means or additional auxiliary cylinders but instead lifting mechanisms are used which are provided on the mobile crane and are already present. The angling procedure is not performed by means of hydraulic cylinders which are to be additionally provided. The angling per se takes place predominantly on the ground or the deposit position of the main jib so that it is not necessary to work far above the upper edge of the mobile crane. The invention makes it possible to angle the main jib extension in the case of a mobile crane standing on even ground and with a horizontally oriented telescopic jib. The last part of the luffing-up of the main jib extension into a 20° or a 40° position is assisted by the luffing cylinder of the main jib. Provision is made that the angling drive is formed such that a lifting mechanism of the mobile crane provides the movement energy for the angling drive. The lever arm is arranged centrally, as seen from above the main jib extension. In this manner, it is not necessary to provide a fork head offset, which compensates for a deformation of the main jib extension, between the main jib and main jib extension. This is particularly important in the case of long narrow jib systems. Also for this reason no auxiliary cylinder is required by means of which a fork head offset has to be compensated for. The moment required for angling is in this case preferably generated via a combination of lifting cable force and a smaller lifting arm together with a force deflection, so that a higher force for angling is available compared with a variant having a long lever arm.

A force increase is achieved by virtue of the fact that the first lever arm is longer than the second lever arm.

Provision is advantageously made that in particular the angling drive engages the main jib on the one hand and engages the main jib extension in the region of its top chord on the other hand. Moreover, the angling drive is advantageously designed in such a way that the main jib extension can be raised and lowered so as to pivot about the luffing axis against the effect of the gravitational force of the main jib extension. In particular, in this case the luffing axis is formed by a lower rolling head spindle.

In association with the present invention, a mobile crane is understood to be both a movable telescopic crane and also a movable crawler crane with a lattice mast jib.

The invention is explained in more detail hereinunder with the aid of an exemplified embodiment illustrated in the drawings.

DESCRIPTION OF THE PREFERRED EMBODIMENTS

Figure 1:
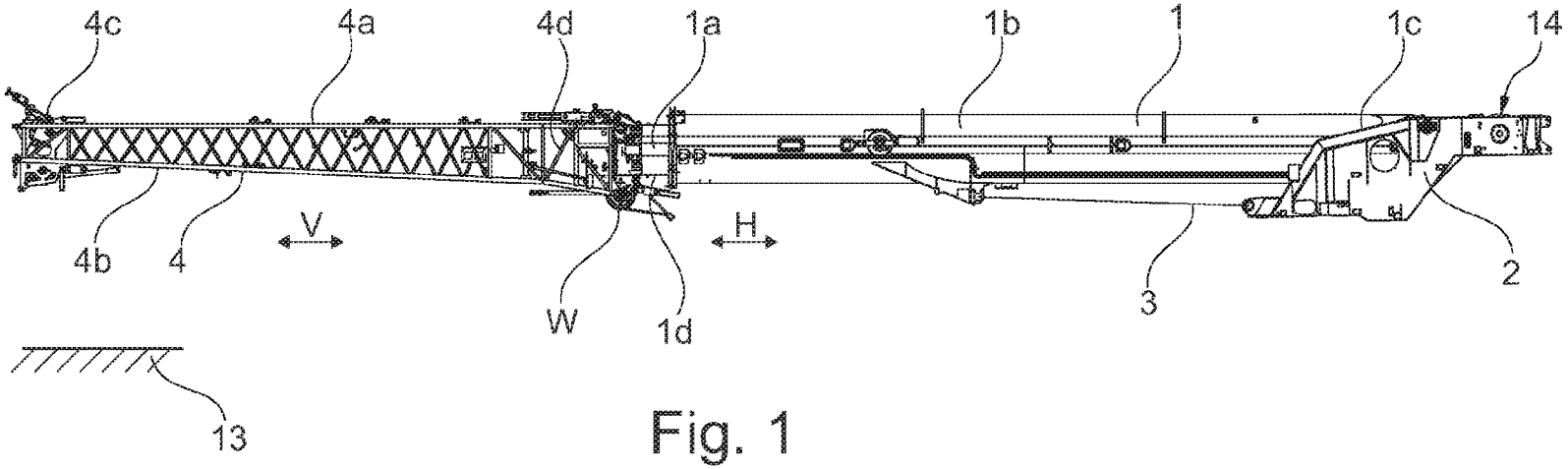
FIG. 1 shows a side view of a main jib with a main jib extension in a basic position.

FIG. 1 shows a side view of a main jib 1 of a telescopic crane, not illustrated. Only a base frame 2 of a superstructure of the telescopic crane is illustrated, in which a lifting mechanism 14 is indicated. On the base frame 2, the main jib 1 with its main jib foot 1*c* is typically mounted so as to be able to pivot about a substantially horizontal axis and can be correspondingly erected and luffed by means of a luffing cylinder 3 which is indicated symbolically by a line and engages on the base frame and on the main jib 1. FIG. 1 shows the main jib 1 in a so-called stored position in which the main jib 1 is oriented with its longitudinal direction substantially horizontal. The main jib 1 is designed as a telescopic jib comprising a basic box 1*b* and telescopic sections 1*d* guided therein and has, a main jib head 1*b* on its end facing away from the base frame 2 of the superstructure, and therefore on the innermost telescopic section 1*d*. The telescopic jib can be extended and retracted in a typical manner by means of a telescopic cylinder, not illustrated, arranged in the innermost telescopic section 1*d*. An extension of the main jib 1 in the form of a main jib extension 4 is releasably fastened to the main jib head 1*b*. The main jib extension 4 can be used temporarily or continuously with the telescopic crane in order to reach an even greater overall jib length exceeding the greatest jib length of the main jib 1, or even to allow work to be carried out behind the structure edges. This main jib extension 4 is designed as a lattice mast which typically has a truss pipe construction. In FIG. 1, the main jib 1 and the main jib extension 4 are located in a 0° position or basic position in which the longitudinal direction H of the main jib 1 and the longitudinal direction V of the main jib extension 4 are aligned with one another or extend in parallel with one another. A so-called luffing angle a of the main jib 1 relative to the superstructure 2 therefore amounts to 0° in the stored position. The luffing angle a describes the raising of the main jib 1 relative to the superstructure 2. In this basic position, the main jib extension 4 is spaced apart from a ground 13 and is therefore supported by the main jib 1 via a bolt connection on the main jib head 1*a*.

Such main jib extensions 4 are fundamentally constructed as modular design systems from individual main elements and can be fitted together depending on the required length or load capacity thereof. The individual main elements have dimensions suitable for transportation and in most cases are not carried along with the telescopic crane but are transported separately. When the spindle loads of the telescopic crane and the construction size of the main jib extension 4 allow, the main jib extension 4 can be carried along if required. This would then be located in a transport position laterally next to and in parallel with the main jib 1. A connection of the individual main elements to one another to form the desired main jib extension 4 is effected via bolt connections in corresponding bolting points A, B, C and D (see FIG. 2). The attachment to the main jib head 1*a* can be effected using the main elements or as a preassembled unit or units.

Figure 2:
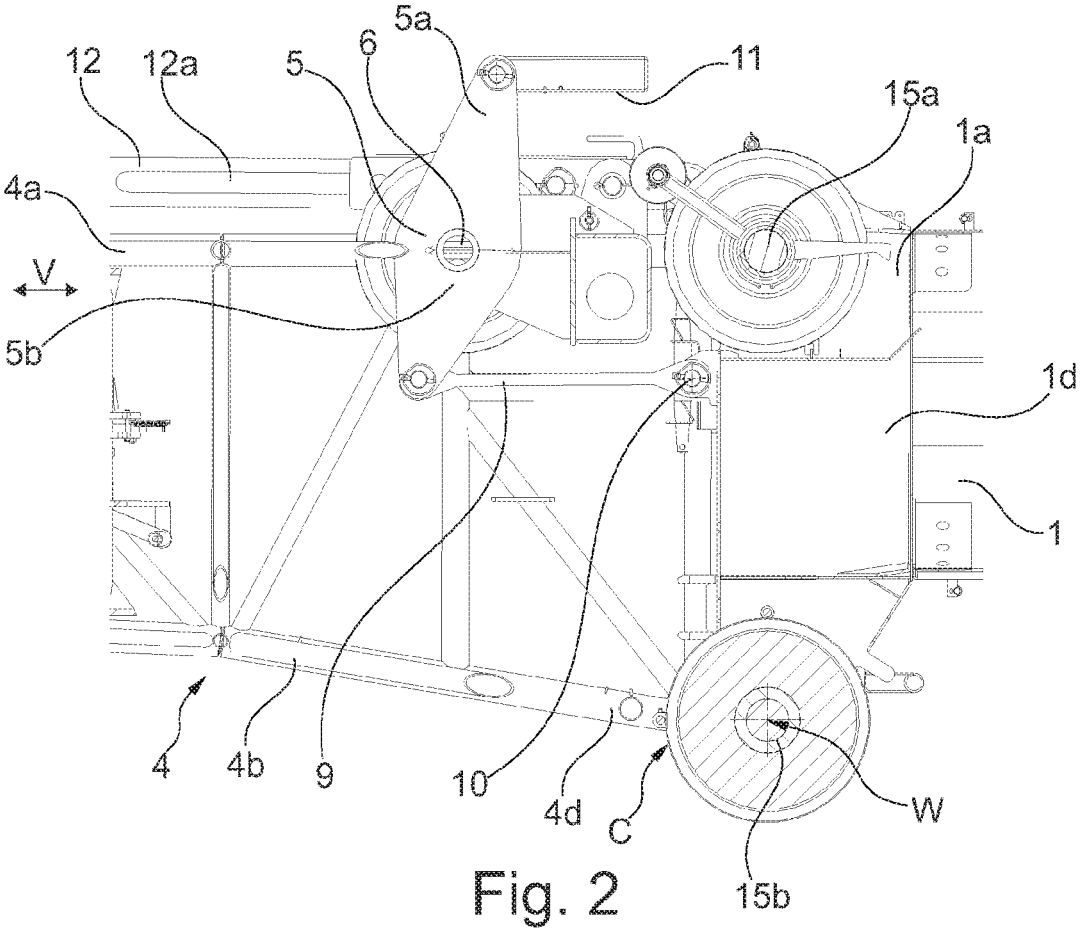
FIG. 2 shows a detailed, partially sectional view of FIG. 1 from the region where the main jib extension is coupled onto the main jib.

FIG. 2 shows a detailed view of FIG. 1 from the region where the main jib extension 4 is coupled onto the main jib 1. The main jib extension 4 comprising, in a conventional manner, a rectangular cross-section, is fastened via four bolt connections disposed in the corner regions of the main jib extension 4 to bolting points A, B, C and D by means of corresponding bolts 7*c* on the main jib 1. The bolting points A, B, C and D are in the region of an upper rolling head spindle 15*a* and lower rolling head spindle 15*b* which are each arranged on the main jib head 1*a*. Each of the four bolt connections is designed as a so-called double shear bolt connection which in a corresponding manner is substantially made up of a fork plate 7*a*, a plate 7*b* and a bolt 7*c* (see also FIGS. 3 and 9). The fork plate 7*a* with its two opposing bores for the bolt 7*c* is fastened at each of the four bolting points A to D to a foot 4*d* of the main jib extension 4 and as an extension of the main jib extension 4. In this case the bores in the fork plate 7*a* are vertically oriented when the main jib extension 1 is horizontal. The plate 7*b* is fastened to the main jib head 1*a* via the upper or lower roller head spindle 15*a*, 15*b*. Accordingly, the plate 7*b* is arranged in each case at the ends and as an extension of the upper or lower roller head spindle 15*a*, 15*b*. When the main jib head 1*a* is oriented horizontally, the upper or lower roller head spindle 15*a*, 15*b* is oriented horizontally and transversely to the longitudinal direction H of the main jib 1 and is rotatably mounted in the main jib head 1*a*. In a corresponding manner, the plate 7*b* is in each case also rotatable about the horizontal upper or lower roller head spindle 15*a*, 15*b*. In each case, the plate 7*b* also comprises a bore which is aligned with the bores of the respective fork plate 7*a*. A bolt 7*c* is inserted into each of the bores in the plate 7*b* and those in the fork plate 7*a* in order to fasten the main jib extension 4 to the main jib head 1*a* in a corresponding manner. The lower connecting element consists, like the upper connecting element, of a fork plate, plate and bolt which are not illustrated in the figures for reasons of clarity.

The two upper bolts 7*c* (see FIG. 3) arranged in the region of a top chord 4*a* of the main jib extension 4 are oriented with their longitudinal axis vertical when the main jib extension 4 is oriented with its longitudinal direction V horizontal. The two further lower bolts arranged in the region of a bottom chord 4*d* of the main jib extension 4 are oriented in a corresponding manner. The lower roller head spindle 15*b*, on which the two lower bolts in the bolting points C and D engage, simultaneously forms a luffing axis W for pivoting of the main jib extension 4 relative to the main jib 1.

FIG. 2 illustrates the main jib extension 4 in cross-section in order to be able to show a lever element 5 mounted in the centre of the main jib extension 4 as seen from above. The lever element 5 comprises, in the manner of a two-arm lever, a first long lever arm 5*a* and a second short lever arm 5*b* and is overall substantially diamond-shaped, wherein the pure diamond shape is distorted corresponding to the long and short lever arm 5*a*, 5*b*. Moreover, the lever element 5 is eccentrically mounted so as to be pivotable about a lever spindle 6 which is arranged in the region of a top chord 4*a* of the main jib extension 4 and is oriented transversely with respect to the longitudinal direction V of the main jib extension 4 and horizontally. A spindle provided for a cable pulley on the main jib extension 4 can be used as the lever spindle 6. The lever element 5 is mounted on the lever spindle 6 such that the long lever arm 5*a* points obliquely upwards and the short lever arm 5*b* points obliquely downwards—in each case as seen when the main jib extension 4 is oriented horizontally. The length ratio between the short and long lever arms 5*a*, 5*b* is approximately 2:1 and therefore a corresponding power gear ratio or force increase is provided. The lower end of the short lever arm 5*b* pointing away from the lever spindle 6 and in the direction of a tip 4*c* of the main jib extension 4 is connected in a hinged manner to a pull rod 9 whose opposite end is articulated on the main jib head 1*a* in a hinged manner at a bolting point 10. The pull rod 9 extends with its longitudinal extension approximately in the longitudinal direction V of the main jib extension 4 and the bolts thereof for fastening to the lever element 5 and the main jib head 1*a* extend in parallel with the lever spindle 6. At the upper end of the long lever arm 5*a* pointing away from the lever spindle 6 and in the direction of a foot 4*d* of the main jib extension 4, a lifting cable 11 originating from a lifting mechanism 14 on the superstructure 2 can be connected in a hinged manner as required. Moreover, in the region of the top chord 4*a* next to the coupling via the two upper bolts 7*c* laterally on the top chord 4*a* in each case a so-called angling plate 12 is arranged, which angling plates are connected at one end to the main jib head 1 a in each case in bolting points E and F and are connected in a central region to the top chord 4*a* of the main jib extension 4 in bolting points G and H. By means of the angling plate 12, it is possible—after releasing the two upper bolts 7*c*—to permit angling of the main jib extension 4 relative to the main jib 1 and about the luffing axis W or to limit said angling to a preselected position. Preferably, starting from the basic position or 0° position of an angling angle b, the main jib extension 4 is moved into a 20° position or 40° position. The angling angle b is formed by the longitudinal direction H of the main jib 1 and the longitudinal direction V of the main jib extension 4 (see FIG. 4). For this purpose, each of the two angling plates 12 is fastened at one end to the main jib head 1*a* in a hinged manner via horizontally extending connecting bolts 12*e* and each has at the other end a stop opening 12*c* whose longitudinal extension extends substantially in parallel with the longitudinal direction V of the main jib extension 4. The angling plate 12 is connected to the main jib extension 4 via a further connecting bolt 12*i* which extends transversely through the stop opening 12*c*. The maximum possible angling of the main jib extension 4—which corresponds to an angling angle b of 40° in the present case—can be set over the selected length of the stop opening 12*c*. By manually and mechanically limiting the length of the stop opening 12*c*, angling of the main jib extension 4 with respect to the main jib 1 can be set in stages in preselected angles. In the present case, this occurs for a 20° position.

Instead of the lower and upper roller head spindles 15*a*, 15*b* provided with this construction of the main jib 1, spindles additionally provided for the attachment of the main jib extension 4 and being oriented and rotatable corresponding to the above-described roller head spindle 9*a* could also be provided on the main jib head 1*a*. The plates 7*b* can also be fastened to the main jib head 1*a* directly and therefore in a non-rotatable manner. In order to achieve the luffability of the main jib extension 4 relative to the main jib 1, the bore for one of the bolts 7*c* in the plate 7*b* must then be oriented horizontally in each case.

Figure 3:
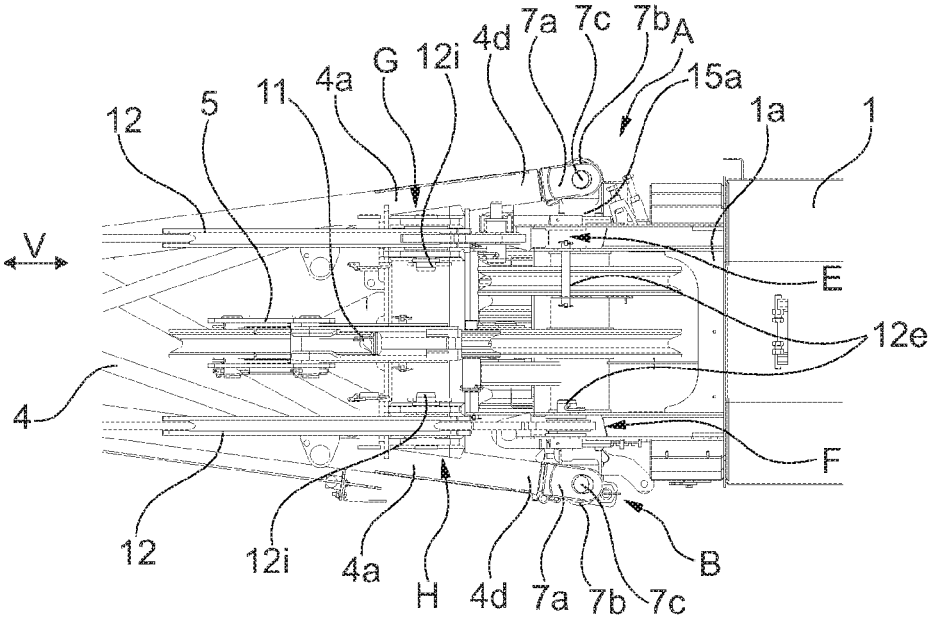
FIG. 3 shows a plan view of FIG. 2.

FIG. 3 shows a plan view of FIG. 2. It can be seen that the two angling plates 12 extend in the region of the long sides of the top chord 4*a* of the main jib extension 4 and in parallel with each other. The two upper bolts 7*c* are also shown in the bolting points A and B, by means of which the main jib extension 4 is attached to the main jib head 1*a*.

Figure 4A:
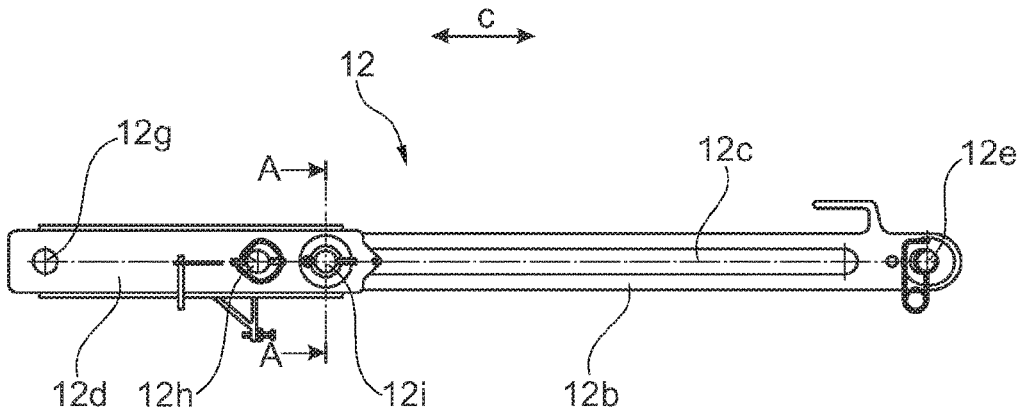
FIG. 4*a* shows a side view of an angling plate in a 40° position.

FIG. 4*a* shows a side view of an angling plate 12 in a maximally extended 40° position. The angling plate 12, by means of which a displacement path and therefore the angling angle b can be manually limited by means of a stop surface 12*a* (see FIG. 4*d*), consists substantially of a sliding plate 12*b* having a long hole-shaped guiding opening 12*c*, at which a guiding plate 12*d* can be guided in the longitudinal direction c of the sliding plate 12*b*. The sliding plate 12*b* is designed as an elongated flat profile having the stop opening 12*c* and extends substantially in parallel with the longitudinal direction v of the main jib extension 1. At an end facing the main jib head 1*a*, the sliding plate 12*b* has a bore 12*j* (see FIG. 4*d*), via which the sliding plate 12*b* is releasably fastened to the main jib head 1*a* at one of the bolting points E and F in each case by means of a connecting bolt 12*e*. The connecting bolt 12*e* is oriented with its longitudinal extension in parallel with the upper or lower rolling head spindle 15*a*, 15*b*. Slid onto the sliding plate 12*b* is the guiding plate 12*d* which for this purpose has a closed rectangular cross-section with a guiding opening 12*f* (see FIG. 4*b*), into which the sliding plate 12*b* is inserted and displaceably guided. The guiding plate 12*d* per se is releasably fastened to the main jib extension 4 at an end facing the main jib head 1*a* by means of in each case a further connecting bolt 12*i* at one of the bolting points G and H. The connecting bolt 12*i* is oriented with its longitudinal extension in parallel with the upper or lower rolling head spindle 15*a*, 15*b*. In this case, the connecting bolt 12*i* is also guided through the stop opening 12*c* of the sliding plate 12*b*. In order to limit a displacement of the guiding plate 12*d* on the sliding plate 12*b*, two stop bores 12*g* (see FIG. 4*d*) which are continuous and spaced apart from one another in the longitudinal direction of the guiding plate 12*d* are arranged in the side parts of the guiding plate 12*d*. A first one of the two stop bores 12*g* serves to limit the angling angle b to 20° and a second one of said stop bores serves to limit said angling angle to 40°. The stop bores 12*g* for 40° are accordingly arranged closer to the main jib head 1 in order to permit a larger displacement path. Depending upon the desired angling angle b, the respective stop bore 12*g* has a stop bolt 12*h* inserted therein which then extends through the two opposite stop bores 12*g* and the stop opening 12*c* located therebetween. In FIG. 4*a*, the connecting bolt 12*h* is inserted into the second one of the two stop bores 12*g* which limits the angling angle b to 40°. The stop bolt 12*h* is guided next to the bolt 12*i* in the stop opening 12*c*. The bolt 12*i* would only come into contact with the opposite stop surface 12*a* of the stop opening 12*c* if no stop bolt 12*h* is inserted. The second one of the two stop bores 12*g* is free.

Figure 4B:
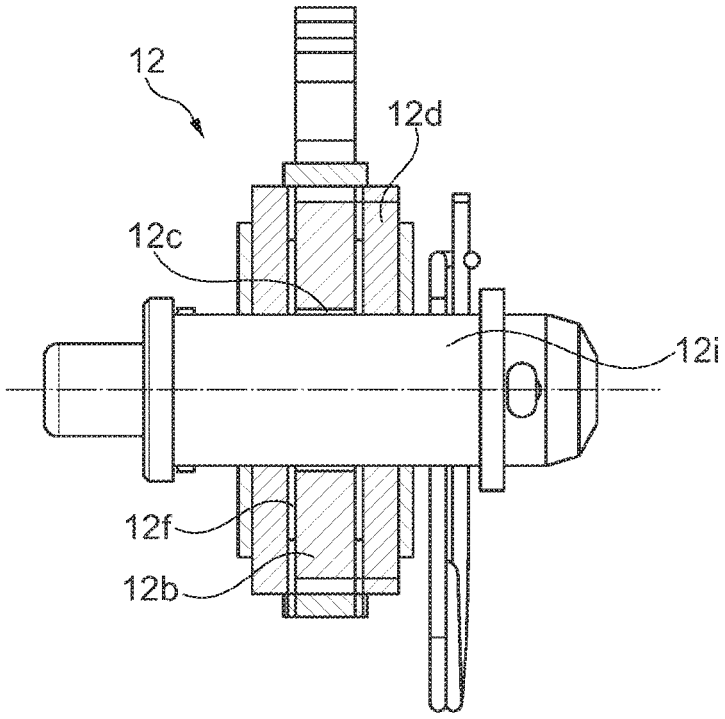
FIG. 4*b* shows a sectional view of FIG. 4*a;*

FIG. 4*b* illustrates a sectional view of FIG. 4*a* taken along section line A-A. It can be seen that the guiding plate 12*d* has a rectangular cross-section having a central guiding opening 12*f*, in which the sliding plate 12*b* with its stop opening 12*c* is guided.

Figure 4C:
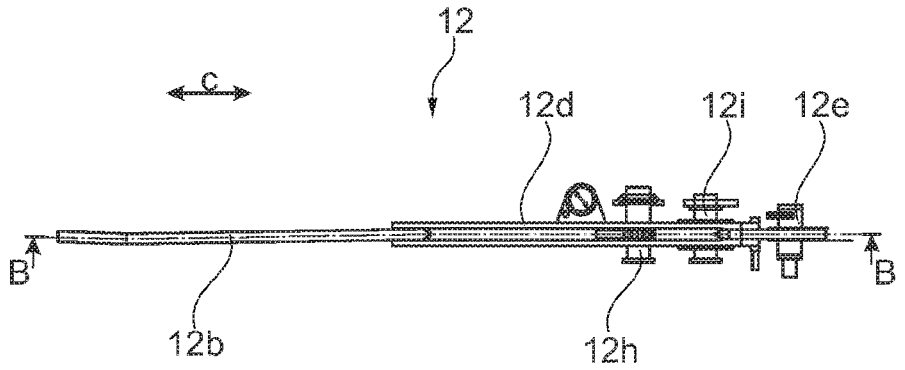
FIG. 4*c* shows a plan view of an angling plate in a transport position.

FIG. 4*c* also illustrates a plan view of an angling plate 12 in a transport position. In this transport position, the angling plate 12 is not fastened to the main jib head 1*a* by means of the connecting bolt 12*e* and the sliding plate 12*b* is inserted in the direction of the main jib extension 4 into the guiding plate 12*d*. The connecting bolt 12*e* and the stop bolt 12*h* are inserted for storage purposes.

Figure 4D:
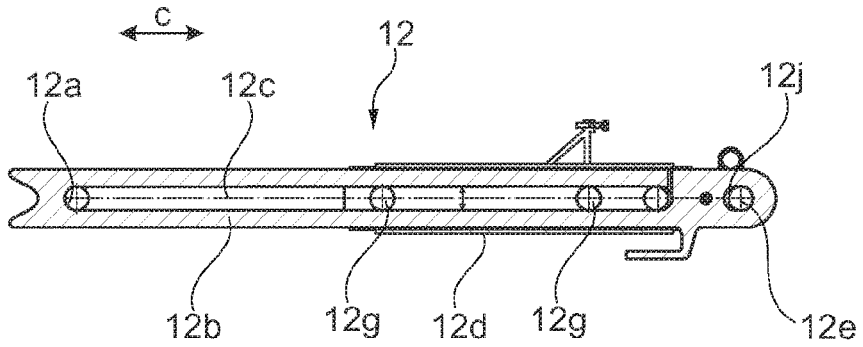
FIG. 4*d* shows a sectional view of FIG. 4*c;*

FIG. 4*d* shows a sectional view of FIG. 4*c* taken along section line B-B in FIG. 4*c*. This view clearly shows the stop opening 12*c* and the two stop bores.

Figure 4E:
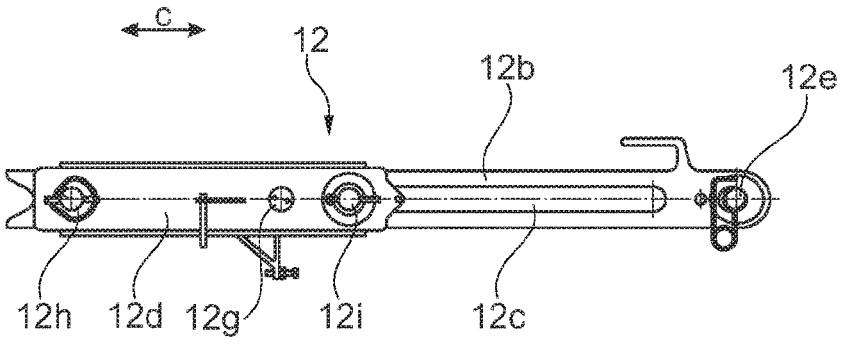
FIG. 4*e* shows a side view of an angling plate in a 20° position.

FIG. 4*e* illustrates a side view of an angling plate 12 which corresponds substantially to the angling plate 12 shown in FIG. 4*a*. Unlike in FIG. 4*a*, the angling plate 12 is not illustrated in the 40° position but instead is illustrated in the 20° position. Accordingly, the stop bolt 12*h* is inserted in the stop bore 12*g* remote from the main jib head 1*a*.

Angling of the main jib extension 4—located in the basic position as per FIG. 1—into a 40° position will be explained hereinunder. In a first step, the lifting cable 11 is connected from the lifting mechanism 14 to the upper long lever arm 5*a* of the lever element 5 (see FIG. 2). Then, the lifting cable 11 is tightened or wound up from the lifting mechanism 14 on the superstructure 2 until the main jib extension 4 is raised slightly via the lever element 5 mounted in the region of the top chord 4*a* of the main jib extension 4 and supported on the main jib head 1*a*, so that the upper bolts 7*c* on the top chord 4*a* of the main jib extension 4 are unburdened. The now unburdened bolts 7*c* are then removed. The main jib extension 4 is now supported via the lower bolts in combination with the lifting cable 11 on the main jib 1. The two angling plates 12 which are already fastened to the main jib extension 4 via the connecting bolts 12*i* are already previously connected to the main jib head 1*a* via further connecting bolts 12*e*, or are connected at the latest at the present time. The now desired maximum displacement path is also set at the angling plates 12 in order to permit or limit the angling of the main jib extension 4 to the 20° or 40° position. For the 40° position, the maximum angling is limited and thus the maximum extending of the angling plate 12 is effected by the insertion of the stop bolt 12*h* in the stop bore 12*g* closer to the connecting bolt 12*i* and the length of the stop opening 12*c* in the sliding plate 12*b* of the angling plate 12. In a subsequent step, the lifting cable 11 is released and in so doing the lever element 5 rotates about the lever spindle 6, the main jib extension 4 pivots about the luffing axis W and is lowered until its tip 4*a* contacts the ground 13.

Figure 5:
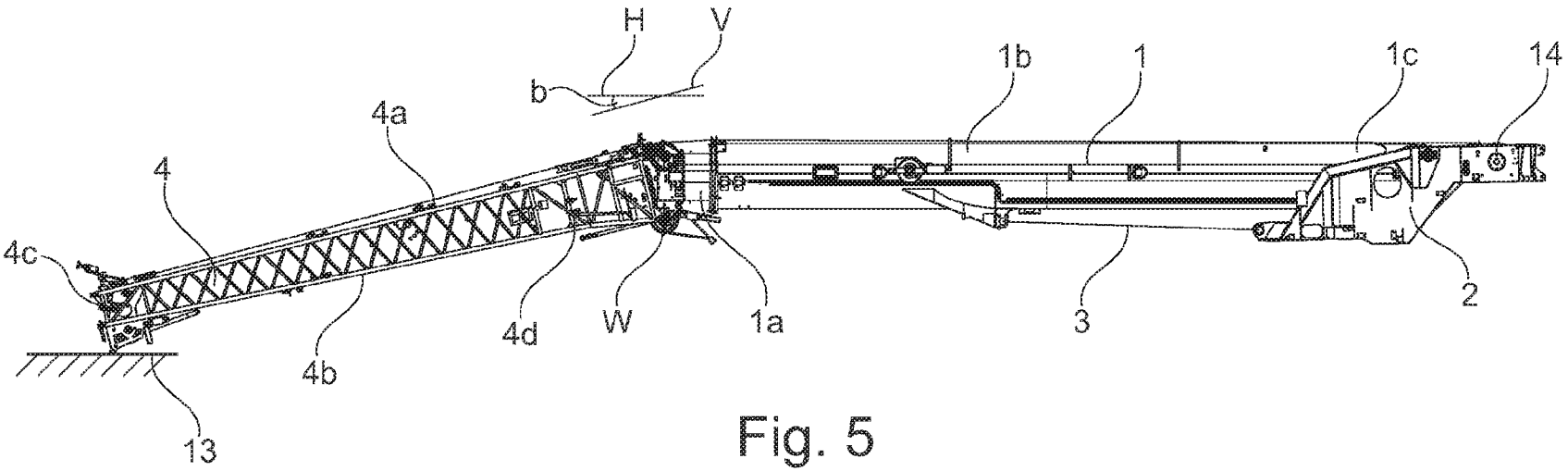
FIG. 5 shows the main jib of FIG. 1 with the main jib extension in a 15° position.

FIG. 5, which shows the main jib 1 according to FIG. 1 with the main jib extension 4 in a 15° position, shows the position described above in which the lowered tip 4*a* is supported on the ground 13.

Figure 6:
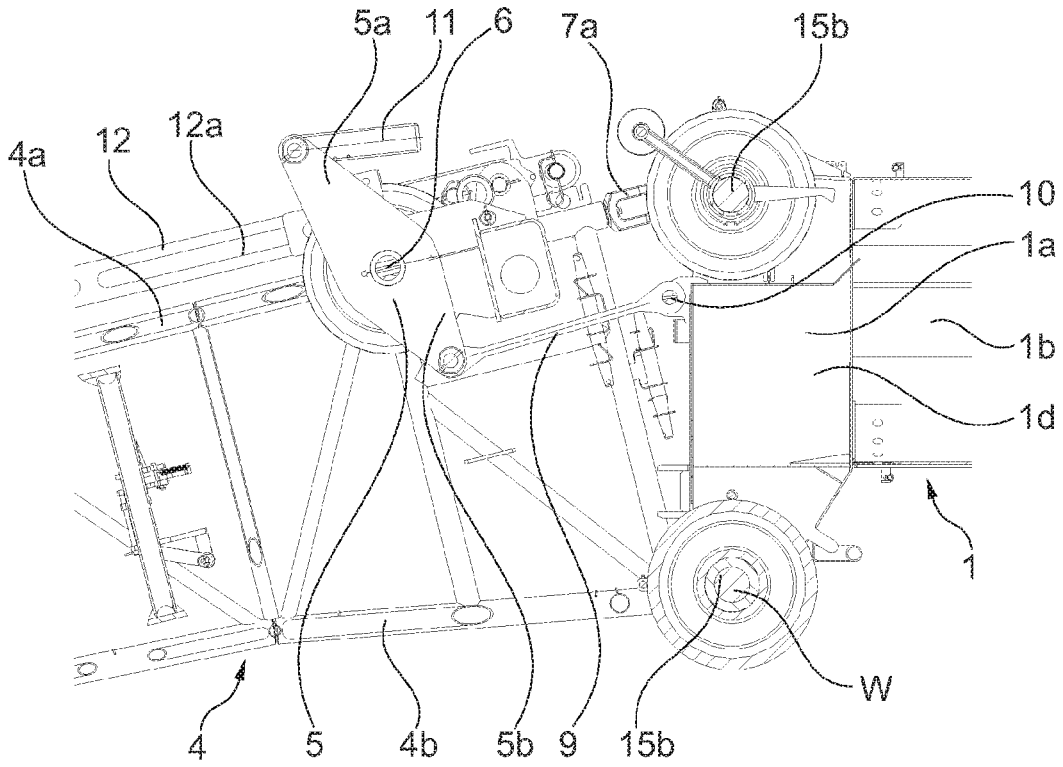
FIG. 6 shows a detailed, partially sectional view of FIG. 5 from the region where the main jib extension is coupled onto the main jib.
Figure 7:
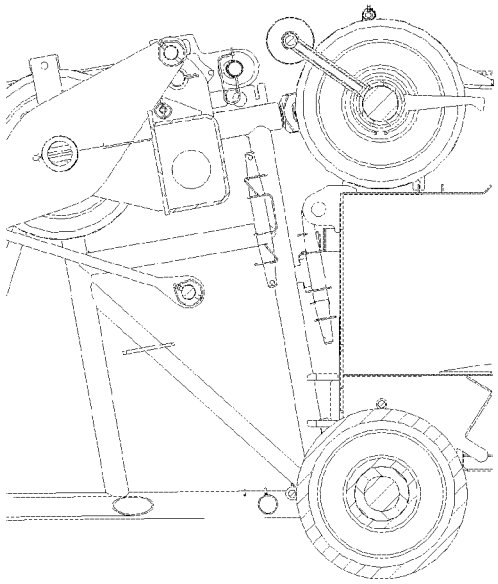
FIG. 7 shows a view as in FIG. 6 with a lever element in the transport position.

FIG. 6 shows a detailed, partially sectional view of FIG. 5 from the region where the main jib extension 4 is coupled onto the main jib 1. This Figure shows that the main jib extension 4 is held in the angled position via the luffing axis W with the lower bolts and by the pull rod 9 together with the lever element 5 on the main jib head 1*a*. The upper bolts 7*c* are pulled and the upper fork plates 7*a* in the region of the top chord 4*a* are free. The lifting cable 11 is just indicated. Also, the sliding plates 12 are not fastened to the main jib head 1*a* in order to more clearly show the upper fork plates 7*a*. The sliding plates 12 are to be fastened, at the latest at the present time, to the main jib head 1*a* via the connecting bolts 12*e* at the bolting points E and F.

Now, because the tip 4*c* is resting on the ground 13 and the lifting cable 11 is unburdened, the pull rod 9 is released from the main jib head 1*a* and the lever element 5 is pivoted together with the pull rod 9 into a transport position. This transport position is shown in FIG. 6 which shows a view corresponding to FIG. 5 with a changed position of the lever element 5 in the transport position. In the transport position, the short and long lever arm 5*a*, 5*b* are oriented more in parallel with the longitudinal direction V of the main jib extension 4.

Figure 8:
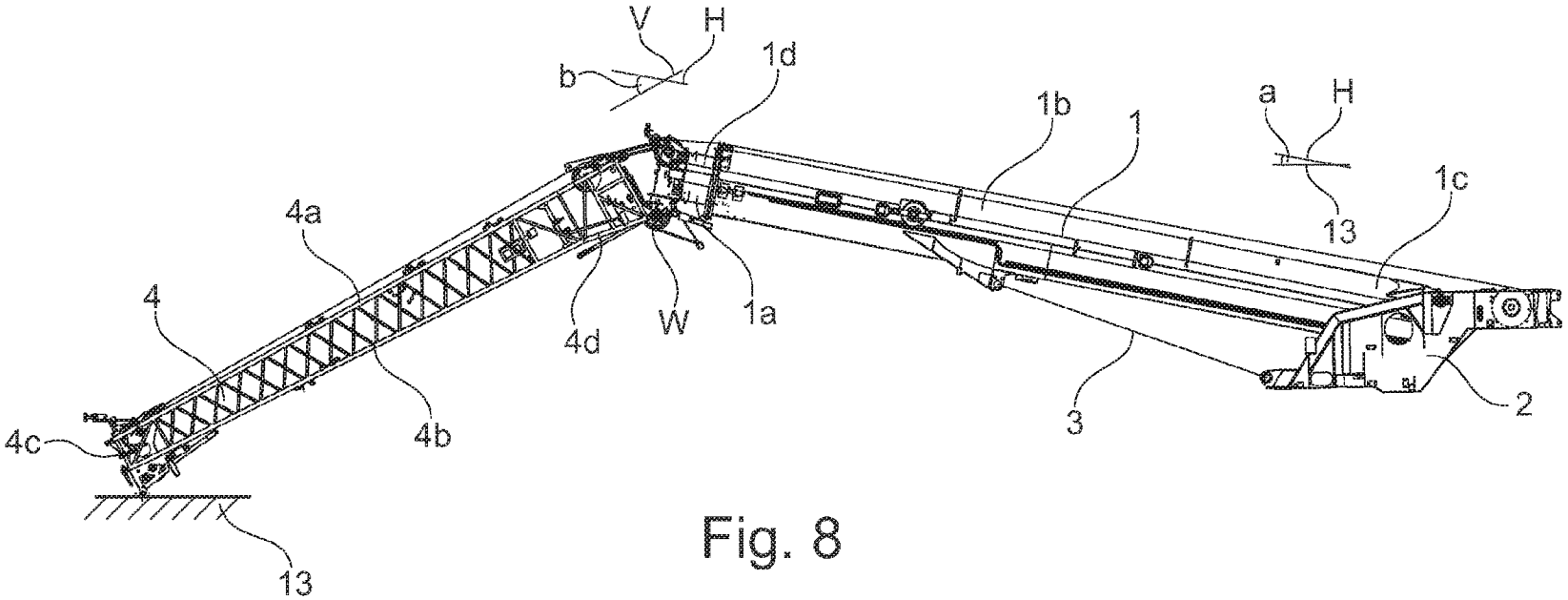
FIG. 8 shows the main jib of FIG. 1 with the main jib extension in a 40° position.

In a further step, by luffing-up the main jib 1, the main jib extension 4 is angled further and the tip 4*c* of the main jib extension 4 slides therethrough over the ground 13 in the direction of the superstructure 2. By means of the luffing-up action, the main jib extension 4 is angled further to a luffing angle a, which is formed by the longitudinal direction H of the main jib 1 and the horizontal of the ground 13, for as long as until the angling plates 12 limit the angling in a preselected position. This position, in which the main jib extension 4 is located in a 40° position relative to the main jib 1, is illustrated in FIG. 8. At the point in time the angling movement is limited by the angling plates 12, the tip 4*c* is still just about in contact with the ground 13. During further luffing-up of the main jib 1, the main jib extension 4 then lifts from the ground 13 until the desired position for the main jib 1 with the main jib extension 4 arranged thereon in a 40° position with respect thereto is reached. In this position, the main jib extension 4 is held by its empty weight. However, corresponding locking in the angling plates 12 may not be provided in the present embodiment.

Angling back the main jib extension 4 takes place in the reverse order.

Figure 9:
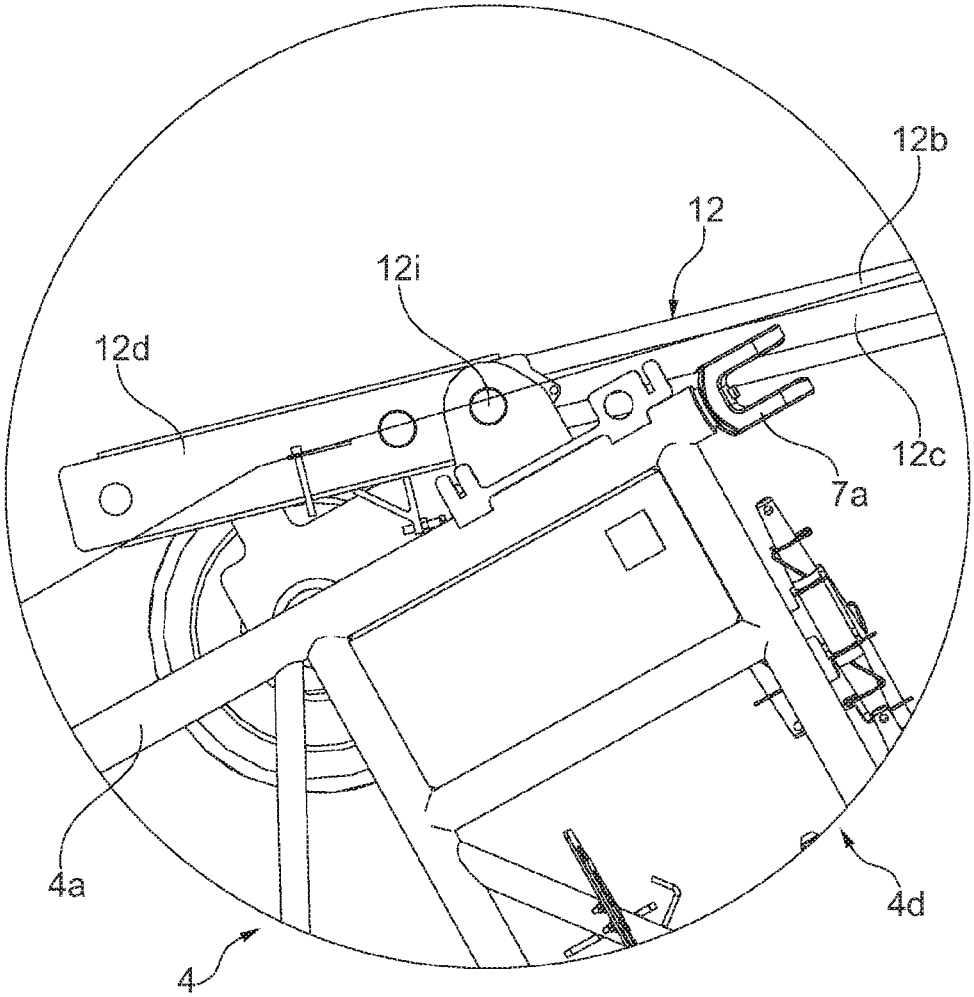
FIG. 9 shows a detailed view of FIG. 8 with an angling plate in a stop position.

FIG. 9 shows a detailed view of FIG. 8 from the region where the main jib extension 4 is coupled onto the main jib 1 with an angling plate 12 in a stop position with respect to a desired maximum angling position.

Although in conjunction with the present exemplified embodiment, the main jib 1 is described as a telescopic jib and the main jib extension 4 is described as a lattice mast jib, the invention can also be applied to other embodiments of the main jib 1 and main jib extension 4. The main jib 1 can also be a lattice mast jib or a combination of a telescopic jib, lattice mast jib and/or box jib. For the main jib extension 4, lattice mast jibs or box jibs or combinations thereof are feasible.

The invention claimed is:

1. A mobile crane, said mobile crane comprising a luffably mounted main jib that is configured to be raised via a luffing cylinder, and with a main jib extension releasably connected to a main jib head of the main jib via upper bolts and lower bolts, wherein the main jib extension, starting from a basic position after release of the upper bolts, is able to be angled about a luffing axis relative to the main jib by an angling drive, wherein a lifting mechanism of the mobile crane that is provided for another task, provides the movement energy for the angling drive, wherein the angling drive comprises a lever element having two lever arms with the lever element being pivotable about a lever spindle mounted on a top chord of the main jib extension, wherein the lever element is mounted to the lever spindle with the lever spindle being between the first lever arm and the second lever arm, and wherein the first lever arm is connected to a lifting cable of the lifting mechanism for operating the angling drive and the second lever arm engages on the main jib head.

2. The mobile crane as claimed in claim 1, wherein the first lever arm is longer than the second lever arm so as to achieve a force increase.

3. The mobile crane as claimed in claim 2, wherein the angling drive engages the main jib on the one hand and engages the main jib extension in the region of the top chord of the main jib extension on the other hand.

4. The mobile crane as claimed in claim 3, wherein the angling drive is configured such that the main jib extension can be raised and lowered in a pivoting manner about the luffing axis against the effect of the gravitational force of the main jib extension.

5. The mobile crane as claimed in claim 4, wherein the luffing axis is formed by a lower rolling head spindle.

6. The mobile crane as claimed in claim 2, wherein the angling drive is configured such that the main jib extension can be raised and lowered in a pivoting manner about the luffing axis against the effect of the gravitational force of the main jib extension.

7. The mobile crane as claimed in claim 6, wherein the luffing axis is formed by a lower rolling head spindle.

8. The mobile crane as claimed in claim 2, wherein the luffing axis is formed by a lower rolling head spindle.

9. The mobile crane as claimed in claim 1, wherein the angling drive engages the main jib on the one hand and engages the main jib extension in the region of the top chord of the main jib extension on the other hand.

10. The mobile crane as claimed in claim 9, wherein the angling drive is configured such that the main jib extension can be raised and lowered in a pivoting manner about the luffing axis against the effect of the gravitational force of the main jib extension.

11. The mobile crane as claimed in claim 9, wherein the luffing axis is formed by a lower rolling head spindle.

12. The mobile crane as claimed in claim 1, wherein the angling drive is configured such that the main jib extension can be raised and lowered in a pivoting manner about the luffing axis against the effect of the gravitational force of the main jib extension.

13. The mobile crane as claimed in claim 12, wherein the luffing axis is formed by a lower rolling head spindle.

14. The mobile crane as claimed in claim 1, wherein the luffing axis is formed by a lower rolling head spindle.

* * * * *